US006109716A

United States Patent [19]

Takahashi

[11] Patent Number: 6,109,716

[45] Date of Patent: Aug. 29, 2000

[54] INK-JET PRINTING APPARATUS HAVING PRINTED HEAD DRIVEN BY INK VISCOSITY DEPENDENT DRIVE PULSE

[75] Inventor: Yoshikazu Takahashi, Nagoya, Japan

[73] Assignee: Brother Kogyo Kabushiki Kaisha, Nagoya, Japan

[21] Appl. No.: 09/037,086

[22] Filed: Mar. 9, 1998

[30] Foreign Application Priority Data

Mar. 28, 1997 [JP] Japan ..... 9-095162
Apr. 1, 1997 [JP] Japan ..... 9-099757

[51] Int. Cl.[7] ..... B41J 29/38

[52] U.S. Cl. ..... 347/11; 347/14

[58] Field of Search ..... 347/6, 11, 14

[56] References Cited

U.S. PATENT DOCUMENTS

| | | | |
|---|---|---|---|
| 4,352,114 | 9/1982 | Kyogoku et al. | 347/14 |
| 4,947,194 | 8/1990 | Kyoshima | 347/14 |
| 4,972,211 | 11/1990 | Aoki | 347/11 |
| 4,980,699 | 12/1990 | Tanabe et al. | 347/14 |
| 5,264,865 | 11/1993 | Shimoda et al. | 347/14 X |
| 5,774,137 | 6/1998 | Yoshida | 347/14 |
| 5,909,228 | 6/1999 | Takahashi | 347/10 |

FOREIGN PATENT DOCUMENTS

| | | |
|---|---|---|
| 61-197247 | 9/1986 | Japan . |
| 62-299343 | 12/1987 | Japan . |
| 63-247051 | 10/1988 | Japan . |
| B-6-9920 | 2/1994 | Japan . |

*Primary Examiner*—Fred L. Braun
*Attorney, Agent, or Firm*—Oliff & Berridge, PLC

[57] ABSTRACT

In an ink-jet printing apparatus, a first drive pulse is applied to a printing head and then a second drive pulse is applied to the printing head. The second drive pulse has a magnitude equal to that of the first drive pulse and a pulse width equal to approximately 1.6 to 1.8 times the one-way propagation time T of pressure wave in an ink channel so that a center of the second drive pulse is provided in a range of approximately 2.25 to 2.75 times the one-way propagation time T from an end time of the first drive pulse. Voltages of the drive pulses to the printing head are regulated according to variation in the viscosity of ink to be ejected. The viscosity of ink is represented by the ambient temperature around the printing head. This arrangement makes it possible to ensure adequacy in volume of ink per droplet and stability in ink droplet ejection rate.

19 Claims, 9 Drawing Sheets

FIG. 6

STABILITY

| Wc (×T) \ d(×T) | 2.20 | 2.25 | 2.30 | 2.50 | 2.70 | 2.75 | 2.80 |
|---|---|---|---|---|---|---|---|
| 0.5 | × | ○ | ◎ | ◎ | ◎ | ○ | × |
| 0.6 | × | ○ | ○ | ○ | ○ | ○ | × |
| 0.7 | × | ○ | ○ | ○ | ○ | ○ | × |
| 1.0 | × | ○ | ○ | ○ | ○ | ○ | × |
| 1.1 | × | ○ | ○ | ○ | ○ | ○ | × |
| 1.2 | × | ○ | ○ | ○ | ○ | ○ | × |
| 1.3 | × | ○ | ◎ | ◎ | ◎ | ○ | × |
| 1.4 | × | ○ | ◎ | ◎ | ◎ | ○ | × |
| 1.5 | × | ○ | ◎ | ◎ | ◎ | ○ | × |
| 1.6 | × | ○ | ◎ | ◎ | ◎ | ○ | × |
| 1.7 | × | ○ | ◎ | ◎ | ◎ | ○ | × |
| 1.8 | × | ○ | ○ | ○ | ○ | ○ | × |
| 1.9 | × | × | × | × | × | × | × |

FIG. 7

VOLUME OF DROPLET (pℓ)

| Wc (×T) \ d(×T) | 2.50 |
|---|---|
| 0.5 | 30 |
| 0.6 | 32 |
| 0.7 | 32 |
| 1 | 35 |
| 1.1 | 35 |
| 1.2 | 34 |
| 1.3 | 35 |
| 1.4 | 37 |
| 1.5 | 35 |
| 1.6 | 42 |
| 1.7 | 43 |
| 1.8 | 45 |

| TEMP. (°C) | DRIVE VOLTAGE (V) A-RANK | B-RANK | C-RANK |
|---|---|---|---|
| 0-5 | 32 | 36 | 40 |
| 5-10 | 30 | 34 | 38 |
| 10-15 | 28 | 32 | 36 |
| 15-20 | 26 | 30 | 34 |
| 20-25 | 24 | 28 | 32 |
| 25-30 | 22 | 26 | 30 |
| 30-35 | 20 | 24 | 28 |
| 35-40 | 18 | 22 | 26 |
| 40-45 | 16 | 20 | 24 |
| 45-50 | 14 | 18 | 22 |

| TEMP (°C) | REFERENCE SIGNAL (V) A-RANK |
|---|---|
| 0-5 | 0.5 |
| 5-10 | 1.0 |
| 10-15 | 1.5 |
| 15-20 | 2.0 |
| 20-25 | 2.5 |
| 25-30 | 3.0 |
| 30-35 | 3.5 |
| 35-40 | 4.0 |
| 40-45 | 4.5 |
| 45-50 | 5.0 |

INK-JET PRINTING APPARATUS HAVING PRINTED HEAD DRIVEN BY INK VISCOSITY DEPENDENT DRIVE PULSE

CROSS REFERENCE TO RELATED APPLICATION

This application relates to and incorporates herein by reference Japanese Patent applications No. 9-95162 filed on Mar. 28, 1997 and No. 9-99757 filed on Apr. 1, 1997.

BACKGROUND OF THE INVENTION

1. Field of the Invention

The present invention relates to ink-jet printing apparatus for printing by ejecting ink droplets onto print media, and more particularly to an ink-jet printing apparatus which is capable of providing stable performance of ink droplet ejection by driving a printing head thereof with a drive voltage varying with ink viscosity.

2. Description of Related Art

Among conventional ink-jet printing apparatuses, there is a drop-on-demand arrangement of a shear mode type using piezoelectric ceramic material as disclosed in Japanese Unexamined Patent Publication No. 63-247051. A printing head used in this kind of ink-jet printing apparatus is shown in FIGS. 12 and 13.

Referring to FIG. 12, a printing head 21 is provided with a cover plate 201 and a base plate 202 which is provided facing the cover plate 201. A part between the cover plate 201 and the base plate 202 is formed with piezoelectric material so that partitions are provided by a plurality of shear mode actuator walls 203 polarized in arrow directions F30 and F40 indicated in FIG. 12, and an ink channel 205 and an air channel 212 are arranged alternately between each pair of shear mode actuator walls 203. One side of each shear mode actuator wall 203 has a film electrode 204, and the other side thereof has a film electrode 214.

As shown in FIG. 13, the front end of the shear mode actuator wall 203 is provided with a nozzle plate 207 which has nozzles 206 each of which is connected with the ink channel 205, and the rear end of the shear mode actuator wall 203 is provided with a manifold part 209 which has a filler part 208 for preventing intrusion of ink from a common ink passage 213 into the air channel 212. The manifold part 209 is used for distributing ink from an ink reservoir (not shown) to each ink channel 205. Each of the electrodes 204 and 214 is covered with an insulating layer (not shown), and the electrode 214 facing the air channel 212 is connected with the ground 211. The electrode 204 forming the ink channel 205 is connected with a head driver IC (integrated circuit) 83 which applies an actuator drive signal to the electrodes 204 and 214.

In the printing head 21 structured as mentioned above, when the head driver IC 83 applies the actuator drive signal to the electrode 204, piezoelectric thickness slip deformation occurs on each shear mode actuator wall 203 to increase a volume of the ink channel 205. For instance, as shown in FIG. 14, when a positive drive voltage is applied to the electrode 204 of the ink channel 205, electric fields are produced on the shear mode actuator wall 203 in arrow directions F10 and F20, causing piezoelectric thickness slip deformation to occur on upper walls 203*a* and lower walls 203*b* of the shear mode actuator wall 203 so that the volume of the ink channel 205 is increased. At this step of operation, pressure in the ink channel 205 including a vicinal part of the nozzle 206 is decreased. This state is maintained during a period of one-way propagation time T of a pressure wave in the ink channel 205, thereby letting ink be supplied from the common ink passage 213 thereinto.

The one-way propagation time T indicates a period of time required for a pressure wave in the ink channel 205 to complete propagation in the longitudinal direction of the ink channel 205. Using length 'L' (FIG. 13) of the ink channel 205 in the longitudinal direction thereof and acoustic velocity 'a' in ink in the ink channel 205, 'T' is expressed as follows; T=L/a.

Based on the principle of pressure wave propagation, pressure in the ink channel 205 is reversed to become positive after a lapse of time T following application of the drive voltage. At the timing of pressure reversal, the drive voltage being applied to the electrode 204 of the ink channel 205 is reset to zero (0) V. Thus, the shear mode actuator wall 203 is restored to normal (FIGS. 12, 13), applying pressure to ink. At this step of operation, the positive pressure is added to pressure which has been produced by restoration of the shear mode actuator wall 203 to normal, so that relatively high pressure is generated in the vicinity of the nozzle 206 in the ink channel 205, thereby ejecting ink from the ink channel 205 to the outside through the nozzle 206.

In such a conventional ink-jet printing apparatus as mentioned above, pressure wave oscillation remains in an ink channel even after ink is ejected. Particularly, when viscosity of ink is low, residual pressure wave oscillation may cause undesired ink droplets to be sprayed or ejected accidentally through the nozzle 206. This unstable ejection of ink droplets makes it rather difficult to attain satisfactory quality of printing.

In another conventional arrangement, disclosed in Japanese Unexamined Patent Publication No. 62-299343 for example, a print pulse for ink droplet ejection is followed by a cancel pulse to reduce residual pressure wave oscillation in an ink channel. More specifically, although a pressure wave for ink droplet ejection rebounds from the front and rear ends of the ink channel and a nozzle meniscus is vibrated after a lapse of time 4T following the start of ink droplet ejection, a pressure wave for phase reversal is produced to cancel this phenomenon.

However, in such an arrangement that the cancel pulse is generated after a lapse of time 4T following the start of ink droplet ejection, a negative power supply for generating reverse-phase cancel pulses is required in addition to a positive power supply for generating ink emission pulses, causing disadvantages of complexity in an electronic control circuit and an increase in production cost.

A further conventional arrangement is disclosed in Japanese Examined Patent Publication No. 6-9920. In this arrangement, a voltage setup part comprising four on-off contacts connected in parallel is provided at an interface of a printing head so that one of 16 drive voltage levels can be selected, and one of these contacts is turned on/off according to characteristics of the printing head for the purpose of setting up an optimum drive voltage. However, this arrangement fails to consider variations in the viscosity of ink caused by variations in the ambient temperature.

More specifically, viscosity of ink used in an ink-jet printing apparatus varies with ambient temperature as shown in FIG. 15, which shows a relationship between viscosity of ink and ambient temperature thereof. For instance, the viscosity of ink is approximately 3 mpa.s at an ambient temperature level of 25° C., but it becomes approximately 6 mpa.s at 10° C. and approximately 2 mpa.s at 40° C. As the viscosity of ink varies thus, a volume of ink per droplet still varies to result in variations in printing quality as shown in FIGS. 16A to 16D.

That is, as shown in FIG. 16A, when a droplet of ink 293 is ejected through the nozzle 206 formed on the nozzle plate 207 in the same manner as shown in FIGS. 12 and 13, a meniscus 292 protrudes from the nozzle 206 frontward (in ejecting direction) due to positive pressure in residual pressure variation in the ink channel 205. Then, as shown in FIG. 16B, the meniscus 292 retracts from the nozzle 206 backward (toward the ink channel 205) due to negative pressure. In this fashion, the meniscus 292 oscillates, and oscillation thereof ceases after a lapse of a certain period of time.

In an experiment, the following phenomena were ascertained. As viscosity of ink decreases, oscillation of the meniscus 292 increases to prolong a period taken until oscillation ceases. Therefore, if the drive voltage is applied to the shear mode actuator to produce pressure in the ink channel 205 through piezoelectric thickness slip deformation before oscillation ceases, a rate of ink droplet ejection increases and also a volume of ink per droplet increases.

Since surface tension of the meniscus 292 on an opening plane of the nozzle 206 decreases with a decrease in viscosity of ink, the meniscus 292 droops to hang out to a surface of the nozzle plate 207 as shown in FIG. 16C. In the presence of a hanging part 294 of the meniscus 292, the subsequent droplet of ink 293 is ejected in a deviated direction as shown in FIG. 16D.

As the viscosity of ink decreases to increase the rate of ink droplet ejection, the volume of ink per droplet causes deviation of the ink droplet ejecting direction, resulting in degradation in performance of ink droplet ejection.

SUMMARY OF THE INVENTION

It is therefore an object of the present invention to provide an ink-jet printing apparatus which is capable of delivering stable ejection of ink droplets to ensure satisfactory quality of printing and suppressing variation in volume of ink per droplet due to variation in ink viscosity.

According to an aspect of the present invention, when a first drive pulse signal is applied to an actuator for changing a volume of an ink channel which is supplied with ink from an ink reservoir, ink is ejected from the ink channel. Then, a second drive pulse signal which has a wave height equal to that of the first drive pulse signal and a wave width equal to approximately 1.6 to 1.8 times the one-way propagation time T of pressure wave in the ink channel is applied to the actuator at the timing that a center of the second drive pulse signal is provided in a range of approximately 2.25 to 2.75 times the one-way propagation time T from a fall time of the first drive pulse signal. Thus, residual pressure wave oscillation in the ink channel can be suppressed to ensure stable ink droplet ejection, thereby making it possible to attain satisfactory quality of printing. Preferably, driving the actuator by both first and second drive voltages is limited to a case when a viscosity of ink to be ejected is high and likely to cause vibration of meniscus by a residual pressure in the ink chamber. The viscosity of ink is determined by an ambient temperature around the actuator.

According to another aspect of the present invention, a drive voltage of a drive signal used for setting a predetermined rate of ink droplet ejection from a nozzle of a printing head is regulated in accordance with viscosity of ink to be ejected. Ambient temperature is detected as a parameter of the viscosity of ink. Preferably, the drive voltage is regulated to a lower value as the viscosity of ink becomes higher so that a residual pressure in an ink chamber of the printing head is reduced to suppress vibrations of a meniscus.

BRIEF DESCRIPTION OF THE DRAWINGS

Other objects, features and advantages of the present invention will be made more apparent from the following detailed description with reference to various embodiments shown in the accompanying drawings. In the drawings:

FIG. 6 is a table showing the results of experiment on stability in ink droplet ejection in the first embodiment;

FIG. 7 is a table showing the results of measurement of volumes of ejected ink droplets in the first embodiment;

DETAILED DESCRIPTION OF THE PREFERRED EMBODIMENTS

Figure 12:
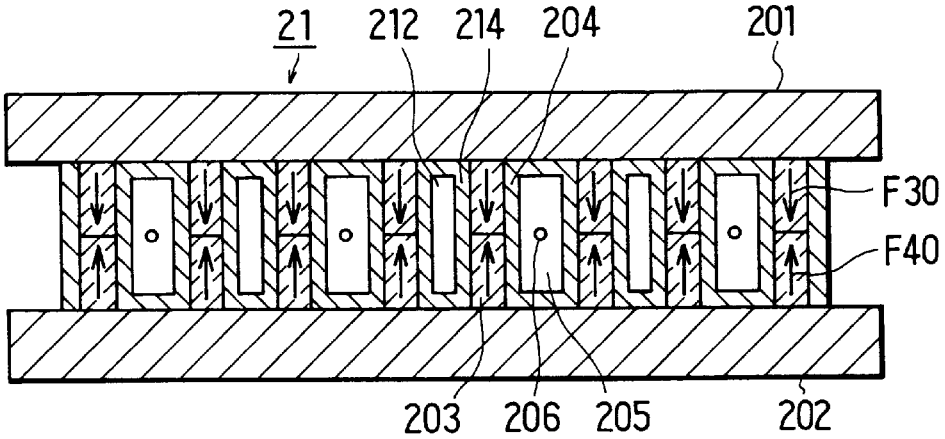
FIG. 12 PRIOR ART
FIG. 12 is a cross-sectional view of a part of a printing head used in a conventional ink-jet printing apparatus.
Figure 13:
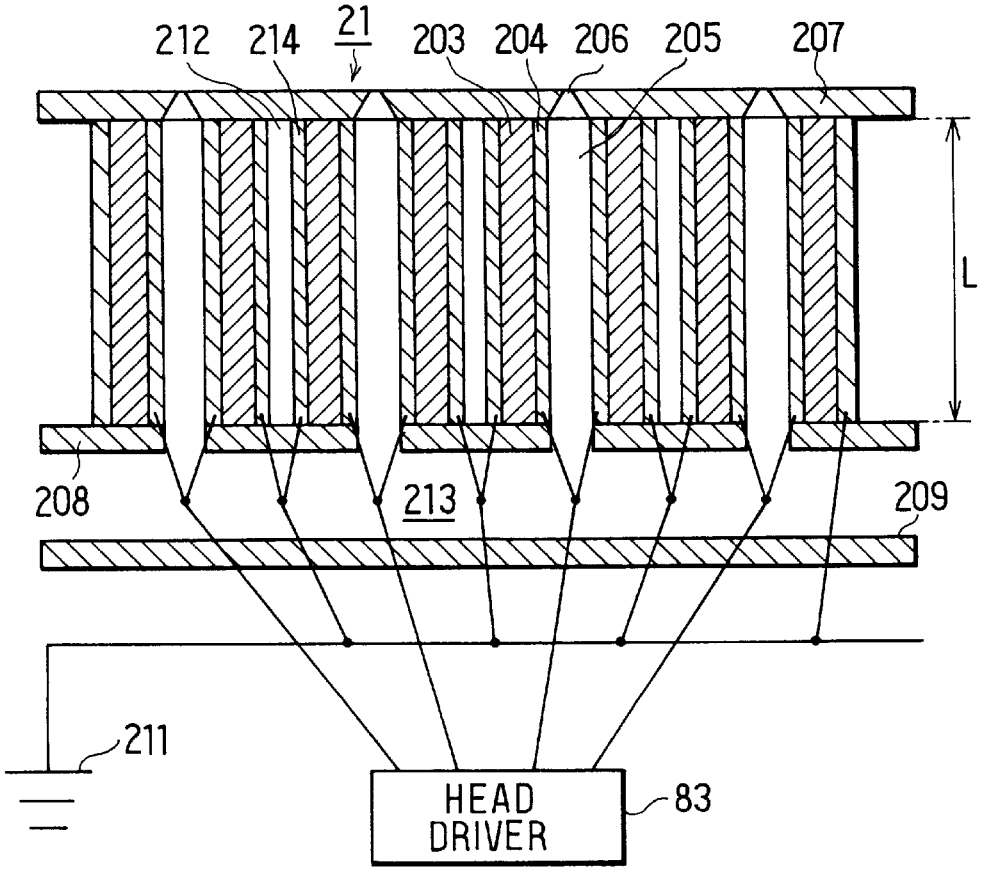
FIG. 13 PRIOR ART
FIG. 13 is a horizontal cross-sectional view of the printing head shown in FIG. 12.

The present invention will now be described in further detail in connection with various embodiments with reference to the accompanying drawings. In the embodiments to follow, an ink-jet printing apparatus is a drop-on-demand ink-jet printing apparatus of a shear mode type using piezoelectric ceramic material as shown in FIGS. 12 and 13.

(First Embodiment)

Figure 1:
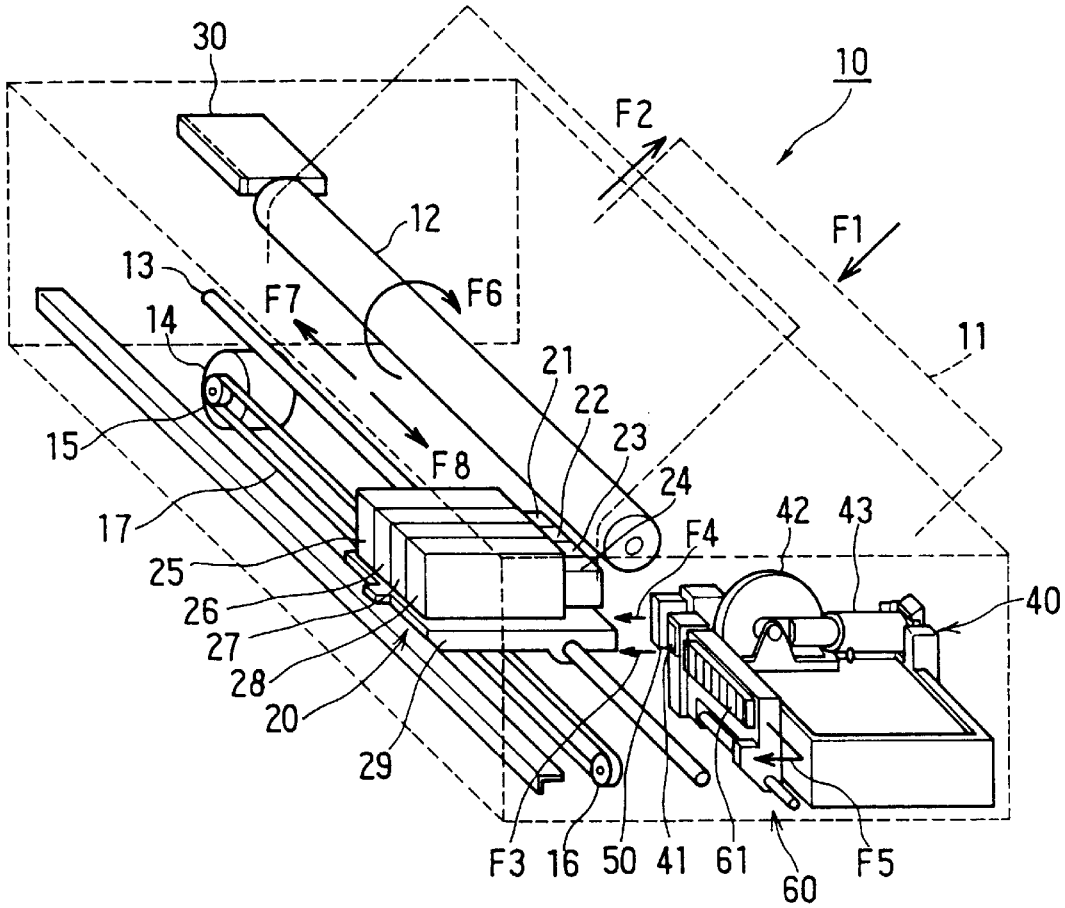
FIG. 1 is a schematic perspective view showing an ink-jet printing apparatus according to the first embodiment of the present invention.

Referring to FIG. 1, a printing apparatus 10 is provided with a platen roller 12 which feeds printing paper 11 in a direction from arrow F1 to arrow F2. Under the platen roller 12, there is provided a carriage shaft 13 in parallel with the axis thereof, and a carriage 29 having a printing head 20 is supported by the carriage shaft 13. A carriage motor 14 is equipped at the lower left of the carriage shaft 13, and a pulley 16 is equipped at the lower right of the carriage shaft 13. A pulley 15 is mounted on a rotor shaft of the carriage motor 14, and an endless belt 17 is hooked between the pulleys 15 and 16.

The carriage 29 is secured on the belt 17. Driven by the carriage motor 14, the carriage 29 slides on the carriage shaft 13 in arrow directions F7 and F8.

The printing head 20 comprises a black-ink head 21 for ejecting black ink, a yellow-ink head 22 for ejecting yellow ink, a cyan-ink head 23 for ejecting cyan ink, and magenta-ink head 24 for ejecting magenta ink. At these heads 21 to 24, ink cartridges 25 to 28 are mounted respectively so that each color ink is supplied to each of the heads 21 to 24.

Figure 14:
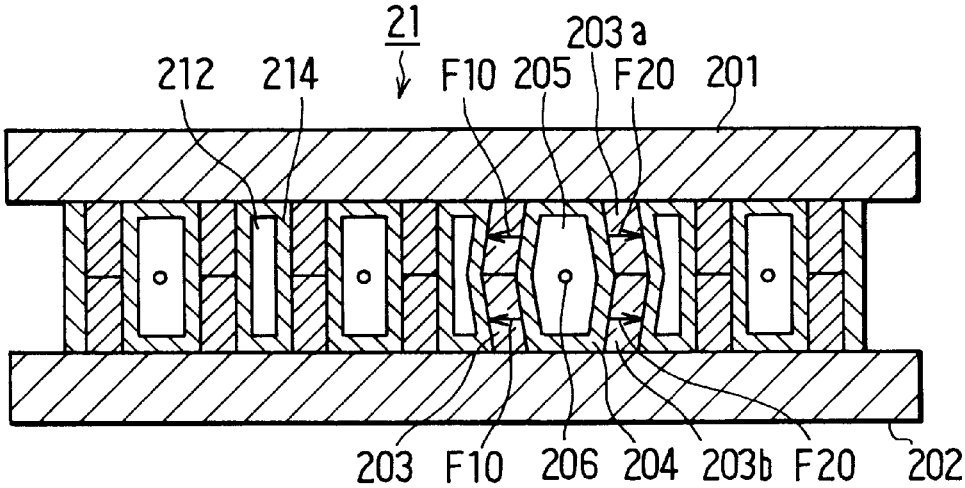
FIG. 14 PRIOR ART
FIG. 14 is a cross-sectional view showing operation of the ink channel in the printing head shown in FIGS. 12 and 13.

Since the basic internal structure of each of the heads 21 to 24 is the same as in the conventional arrangement shown in FIGS. 12 to 14, the description thereof is omitted here.

At a predetermined position on the left side of the platen roller 12, which is an outside region of printing with respect to printing paper 11, an ink absorber pad 30 is provided for absorbing ink to be ejected from each of the heads 21 to 24 at the time of flushing operation. For flushing, two kinds of operations are performed; post-purge flushing and normal flushing. The post-purge flushing is performed for the purpose of discharging unfavorable ink containing air bubbles which may intrude from the nozzle when a suction cap is removed at the time of purging, and the normal flushing is performed at intervals of a predetermined time for the purpose of preventing faulty ejection of ink due to drying-up of ink at each nozzle.

On the right side of the platen roller 12, which is also an outside region of printing, a purge device 40 is provided for removing a possible non-emission or faulty ejection condition from each of the heads 21 to 24. The purge device 40 comprises a suction cap 41 which is used to cover a nozzle-formed part of each of the heads 21 to 24. When each of these heads is set at a purging position, the suction cap 41 is advanced in arrow direction F3 by rotation of a cam 42 so that the nozzle-formed part of each head is covered. Then, a pump 43 is driven to produce negative pressure, whereby unfavorable ink containing air bubbles in an ink channel of each of the heads 21 to 24 is sucked in succession for recovery of the ink ejecting function of each head.

On the left side of the suction cap 41, there is provided a wiper member 50 for removing residual ink and any foreign matter which remains on the nozzle-formed part of each of the heads 21 to 24 after the purging operation. Upon completion of purging each head, the wiper member 50 is advanced in arrow direction F4 to clean up the nozzle-formed part of each of the heads 21 to 24 to be returned into the printing region. Thus, residual ink and any foreign matter are removed from the nozzle-formed part to prevent the printing face of printing paper 11 from being smudged or blotted with ink.

On the right side of the suction cap 41, there is provided a capping device 60 for putting each cap 61 on the nozzle-formed part of each of the heads 21 to 24 when the printing head 20 is reset to a home position thereof. Each cap 61 is advanced in arrow direction F5 when the printing head 20 is reset to the home position, thereby covering the nozzle-formed part of each of the heads 21 to 24. Thus, while the printing apparatus 10 is not in use, ink drying-up is prevented at each of the heads 21 to 24.

In the printing apparatus 10 configured as shown in FIGS. 12 and 13, when a drive pulse signal is applied to electrodes 204 and 214 from a head driver IC 83, a shear mode actuator wall 203 sandwiched between the electrodes 204 and 214 is subjected to piezoelectric thickness slip deformation to change pressure in an ink channel 205, thereby ejecting an ink droplet through a nozzle 206 connected with the ink channel 205 to eject ink onto printing paper 11.

Figure 2:
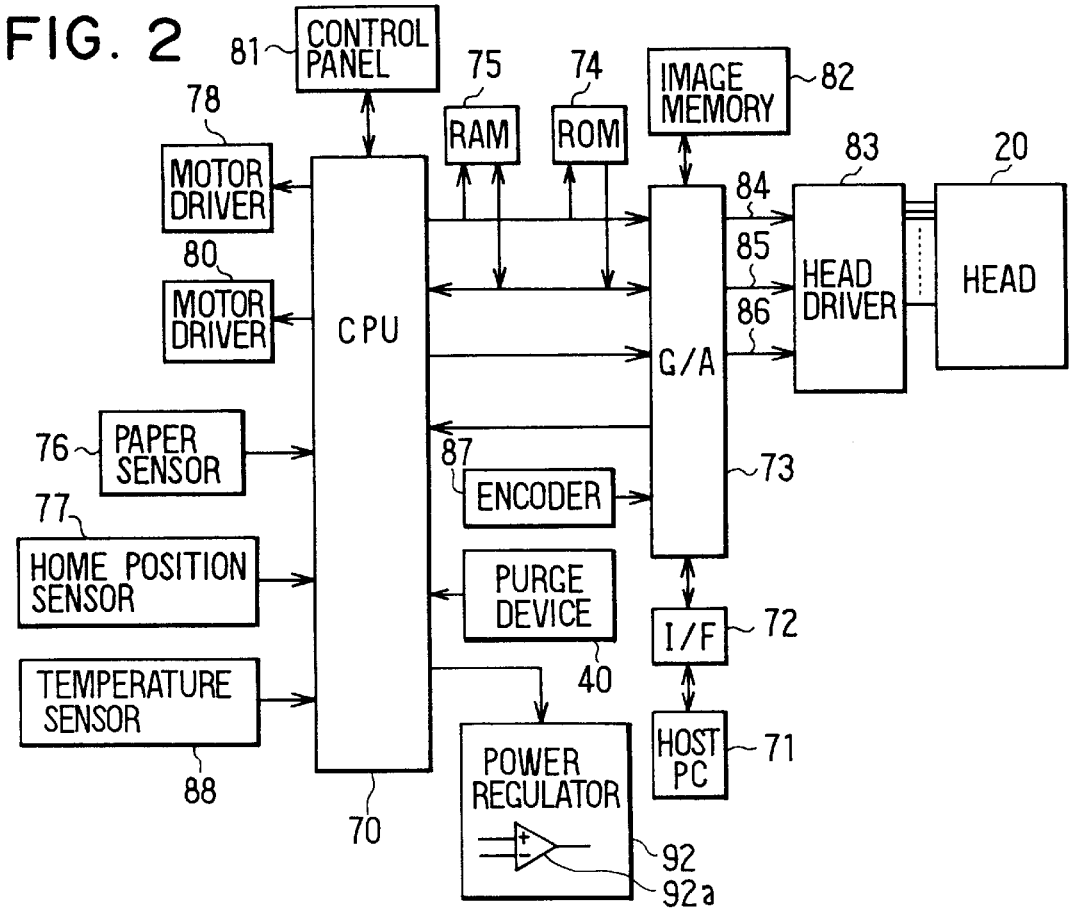
FIG. 2 is a block diagram showing a control circuit used in the first embodiment shown in FIG. 1.

Referring to FIG. 2, there is shown a control circuit of the printing apparatus 10. The control circuit comprises a CPU 70 which issues a printing operation instruction and a flushing instruction to the printing head 20, outputs a purging instruction to the purge device 40 and carries out control of other devices including the above mentioned parts, and a gate array (G/A) 73 which receives printing data from a host computer 71 through an interface (I/F) 72 and carries out control for development of printing data. Between the CPU 70 and the gate array 73, there are provided a ROM 74 which stores control programs, etc. and a RAM 75 which temporarily stores the printing data received from the host computer 71 by the gate array 73. In this arrangement, necessary data are input/output among these parts.

The CPU 70 is connected with a paper sensor 76 for detecting the presence or absence of printing paper 11, a home position sensor 77 for checking whether the printing head 20 is set at the home position thereof, a temperature sensor 88 for detecting an ambient temperature level in an environment where the printing apparatus 10 is installed, a first motor driver 78 for driving the carriage motor 14, a second motor driver 80 for driving a line feed (LF) motor (not shown) for rotation of the platen roller 12, a control panel 81 for giving various signals to the CPU 70, etc. The gate array 73 is connected with an image memory 82 in which printing data received from the host computer 71 is temporarily stored as image data. The head driver IC 83 drives the printing head 20 according to printing data 84, a transfer clock signal 85 and a printing clock signal 86 output from the gate array 73. The gate array 73 is also connected with an encoder sensor 87 which measures a travel speed of the carriage 29 to determine a time point of printing.

The CPU 70 is further connected to a power regulator circuit 92 which controls a magnitude of a drive voltage applied to the printing head 20 by the head driver IC 83.

Figure 3A:
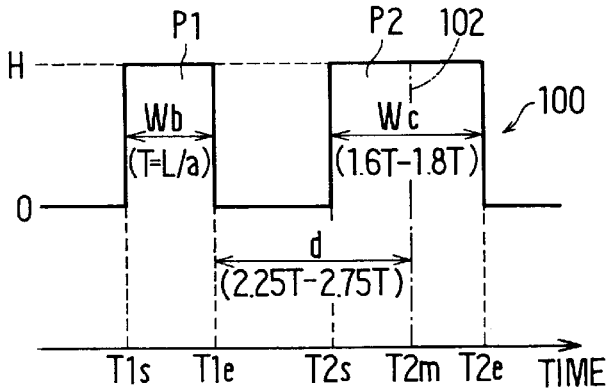
FIG. 3A is a waveform chart of a drive pulse signal used in the first embodiment.

Referring to FIG. 3A, a drive pulse signal 100 supplied to each head from the head driver IC 83 comprises a first drive pulse P1 which rises at time T1s and falls at time T1e for ejecting ink and a second drive pulse P2 which rises at time T2s and falls at time T2e for compensating for variation in residual pressure in the ink channel 205 after ink ejection. The first drive pulse P1 and second drive pulse P2 have the same wave height (magnitude) H.

A pulse width Wb of the first drive pulse P1 corresponds to a one-way propagation time T (L/a) of pressure wave in the ink channel 205. As explained with reference to FIGS. 12 and 13, the ink channel 205 is expanded in terms of volume at a rise (start) of the first drive pulse P1 and the ink channel 205 is restored to normal at a fall (end) of the first drive pulse P1, thereby emitting a droplet of ink. In case that the pulse width Wb is an odd-numbered multiple of T, ink droplet ejection is performed similarly. A pulse width Wc of the second drive pulse P2 corresponds to a period which is 1.6 to 1.8 times the one-way propagation time T (L/a) of pressure wave in the ink channel 205. The second drive pulse P2 rises at time T2s so that a center 102 thereof which corresponds to timing T2m is provided in a range of 2.25 to 2.75 times the one-way propagation time T of pressure wave in the ink channel 205 from the fall time T1e of the first drive pulse P1.

More specifically, in FIG. 3A, the second drive pulse P2 rises to provide condition "d=2.25T to 2.75T". It is to be noted that the second drive pulse P2 is used for suppressing residual pressure wave oscillation in the ink channel caused by the first drive pulse P1, i.e., the second drive pulse P2 is not used for ink droplet ejection. In the present preferred embodiment, a wave height value H of the first drive pulse P1 is. 22 V, a one-way propagation time T is 12 μsec., and a period 'd' is 27 to 33 μsec.

Figure 4:
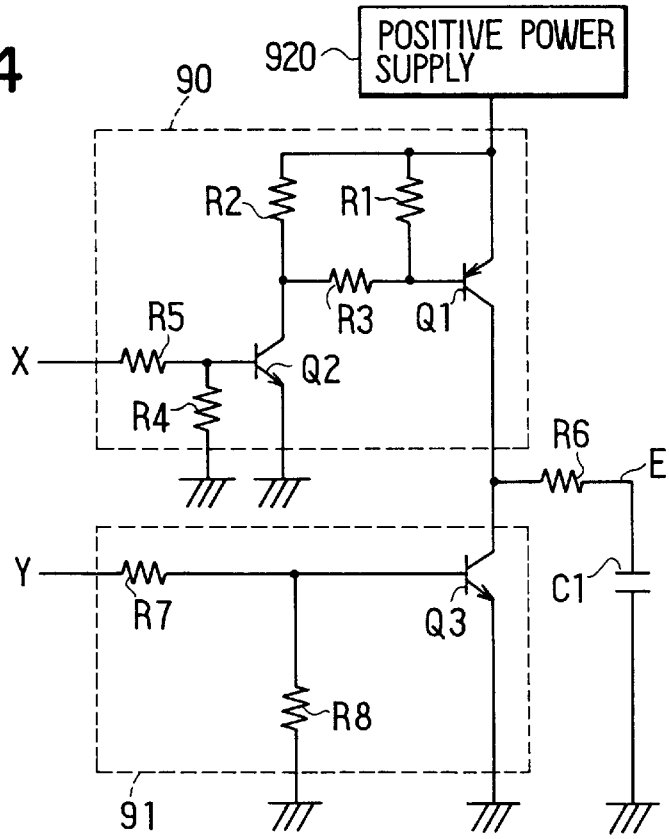
FIG. 4 is an electric wiring diagram of a hear driver circuit used in the first embodiment.

Referring to FIG. 4 showing the head driver IC 83, with input signals X and Y, a drive voltage applied to the electrode 204 of the ink channel 205 is set to level V or 0 (zero). When the input signal X turns on, a drive voltage is applied, and when the input signal Y turns on, a drive voltage becomes 0 (zero). A capacitor C1 is provided by the shear mode actuator wall 203 of the ink channel 205 and a pair of electrodes 204 and 214 formed on both sides thereof.

The drive circuit comprises an ejection charge circuit 90 and an ejection discharge circuit 91. When the input signal X turns on, it is fed to a base of transistor Q2 through resistor R5 to turn on transistor Q2. Then, since a base potential at transistor Q1 decreases when transistor Q2 turns on, transistor Q1 turns on to apply voltage, e.g., 22 V from a positive power supply 920 to capacitor C1 (voltage E). When the input signal Y turns on, it is fed to a base of transistor Q3 through resistor R7 to turn on transistor Q3, thereby grounding capacitor C1 (voltage E) through resistor R6.

Figure 5:
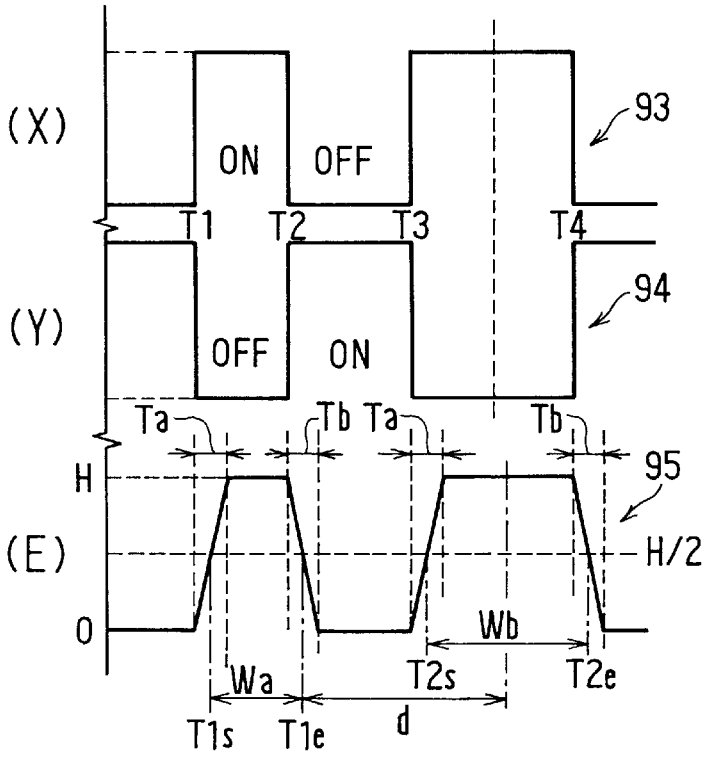
FIG. 5 is a time chart showing a relationship between input signals X and Y and waveform of voltage E in the first embodiment.

Referring to FIG. 5, there is shown a relationship between timings of the input signals X and Y for the drive pulse signal 100 and waveform of voltage E across capacitor C1.

The input signal X indicated in a timing chart 93 remains off normally. The input signal X turns on (rises) at a predetermined time T1 of ink droplet ejection and it turns off (falls) at a predetermined time T2. Then, the input signal X turns on at a predetermined time T3 and it turns off at a predetermined time T4. As indicated in timing chart 94, the input signal Y turns off when the input signal X turns on and it turns on when the input signal X turns off.

Figure 3B:
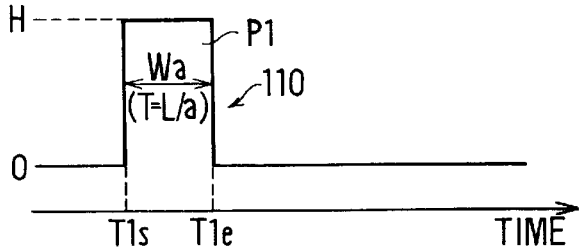
FIG. 3B is a waveform chart of a drive pulse signal used in the second embodiment.

In a timing chart 95 showing an actual waveform of voltage E, timings T1s, T1e, T2s and T2e are used in correspondence with FIGS. 3A and 3B and a dotted line between 0 and H (e.g., 22V) indicates H/2 (e.g., 11V). The voltage E remains 0 V normally. At the predetermined time T1, capacitor C1 is charged, and voltage E is increased to the height H after a lapse of a charge time Ta which is determined by transistor Q1, resistor R6 and capacitor C1. Then, at the predetermined time T2, capacitor C1 is discharged, and voltage E is decreased to 0 V after a lapse of a discharge time Tb which is determined by transistor Q3, resistor R6 and capacitor C1. Thereafter, at the predetermined T3, capacitor C1 is charged, and voltage E is decreased to 0 V after a lapse of a discharge time Tb.

Ink ejection performance in which the printing head 20 was driven using the drive pulse signal 100 (more specifically as shown in FIG. 5) was analyzed. FIG. 6 shows the results of ink ejection stability test, and FIG. 7 shows the results of measurement of volumes of ejected ink droplets.

Figure 15:
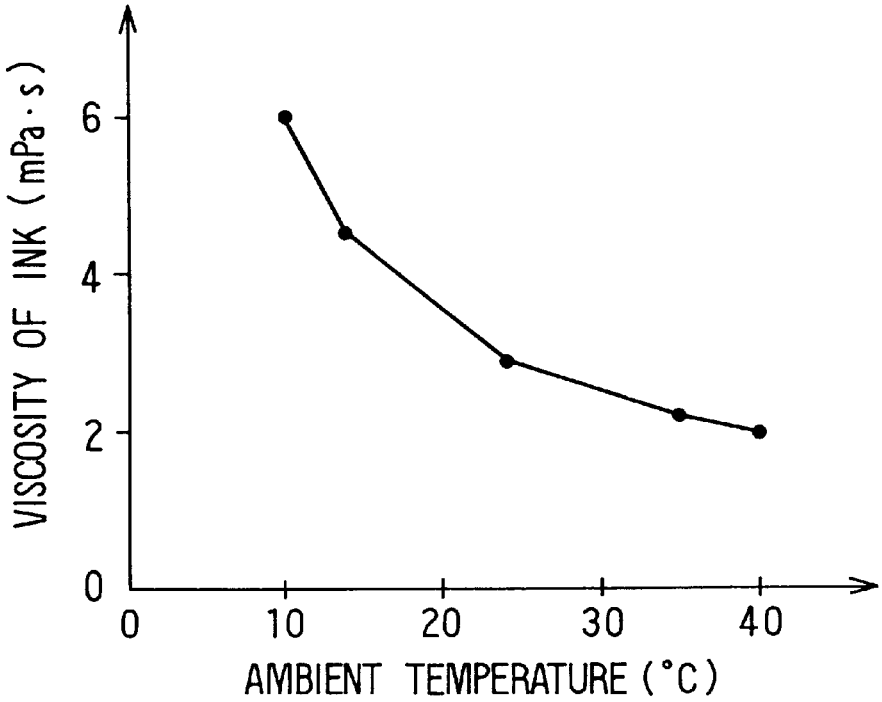
FIG. 15 PRIOR ART
FIG. 15 is a graph showing a relationship between viscosity of ink and ambient temperature.
Figure 16A:
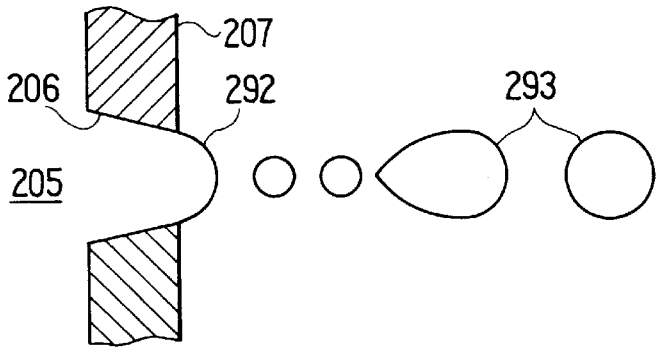
FIG. 16A PRIOR ART
FIGS. 16A to 16D are schematic views showing operation of the printing head in the conventional apparatus.
Figure 16B:
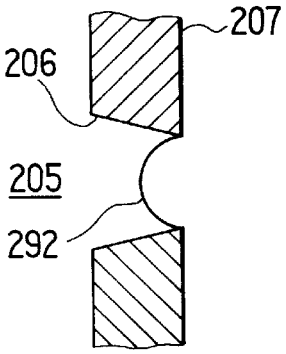
FIG. 16B PRIOR ART
Figure 16C:
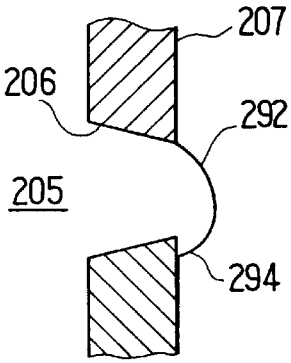
FIG. 16C PRIOR ART
Figure 16D:
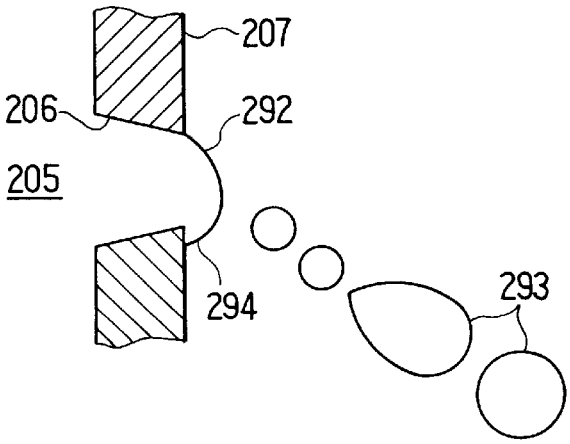
FIG. 16D PRIOR ART

In this experiment, the ink channel 205 of the printing head was 7.5 mm in length (L). The nozzle 206 was 35 μm in diameter on the ink ejection side and 72 μm in diameter on the ink channel side, and the length of the nozzle 206 was 100 μm. Ink had viscosity of 3 mpa.s at a temperature of 25° C., and surface tension thereof was 30 mN/m. As to variation in viscosity of ink, it was 6 mPa.s at a temperature of 10° C. and 2 mpa.s at a temperature of 40° C. as shown in FIG. 15. The ratio of acoustic velocity 'a' in ink in the ink channel 205 to length 'L' of the ink channel 205 was 12 μsec. (L/a=T).

In our experiment, variations in ink drop ejection rate were measured in continuous operation at a drive frequency of 10 kHz under condition that a drive voltage of the drive pulse signal 100 was 22 V and an ambient temperature was 40° C. Also, in the experiment, while changing the pulse width Wc of the second drive pulse P2 in a range of 0.5T to 1.9T, a period 'd' between the fall time T1e of the first drive pulse P1 and the center 102 of the second drive pulse P2 was changed in a range from 2.20 to 2.80. A target value of emission rate was 8 m/sec., and a target value of volume of ink per droplet was 40 pl (picoliters).

In the evaluation, '◎' was given as an indicator of minimum-level variation in ink droplet ejection rate in case that variation in ejection rate was less than 1.0 m/sec. In case that variation in ejection rate was 1.0 to less than 2.0 m/sec., 'O' was given. In case that variation in ejection rate was 2.0 m/sec. to less than 3.0 m/sec., 'Δ' was given. In case that such an irregularity as undesired spraying of ink or undesired ejection of ink droplet was found, 'x' is given to indicate a condition of faulty ejection.

As understood from the experimental results shown in FIG. 6, variation in ink droplet ejection rate was minimized under condition that the period 'd' was 2.3T, 2.5T and 2.7T and the pulse width Wc of the second drive pulse P2 is 0.5T and 1.3T to 1.7T.

Then, in measurement of volumes of ejected ink droplets, a period of 2.5T was selected as a representative of the three values 'd' indicated above, and the pulse width Wc of the second drive pulse P2 was changed in a range of 0.5T to 1.8T.

As understood from FIG. 7, the volume of ink per droplet was 40 pl (target value) or higher when the pulse width Wc of the second drive pulse P2 was in a range of 1.6T to 1.8T. Accordingly, in case that the period 'd' is 2.3T to 2.7T and the pulse width Wc of the second drive pulse P2 is 1.6T to 1.7T, ejection of ink droplets is most stable and an adequate volume of ink per droplet can be ensured.

On the assumption that satisfactory quality of printing can be maintained in case that variation in ink droplet ejection rate is in a range of 1.0 to 2.0 m/s, this allowable range can be attained even in case that the period 'd' is 2.25T or 2.75T and the pulse width Wc is 0.5T to 1.8T as shown by 'O' in FIG. 6.

It is therefore apparent that both the requirements of stable ejection of ink droplets and proper volume of ink per droplet can be satisfied where the pulse width Wc of the second drive pulse P2 is 1.6T to 1.8T and the period 'd' between the fall time of the first drive pulse P1 and the center 102 of the second drive pulse P2 is 2.25T to 2.75T.

As described above, according to the first preferred embodiment of the printing apparatus 10, it is possible to realize an ink-jet printing apparatus capable of ensuring a proper volume of ink per droplet for enhancing quality of printing.

(Second Embodiment)

In the second embodiment, the same arrangement as that of the first embodiment is provided except for a drive pulse signal to be applied to the printing head 20.

A drive pulse signal 110 shown in FIG. 3B has the same wave height (magnitude) H as that of the drive pulse signal 100 indicated in FIG. 3A. At a rise time T1s, voltage becomes H (e.g., 22 V) and, at a fall time of T1e, voltage is decreased to 0 (zero). A pulse width Wa of the drive pulse signal 110 is equal to the pulse width Wb of first drive pulse P1 of the drive pulse signal 100, i.e., Wa=T.

When the ambient temperature detected by the temperature sensor 88 exceeds a predetermined temperature level, the drive pulse signal 100 (FIG. 3A) is used to drive the printing head 20. While the ambient temperature detected by the temperature sensor 88 is less than the predetermined temperature level, the printing head 20 is driven by the drive pulse signal 110 (FIG. 3B).

More specifically, since the viscosity of ink used for printing decreases with an increase in ambient temperature as shown in FIG. 15, the printing head 20 is driven by the drive pulse signal 100 when the ambient temperature is higher than the predetermined level, thereby preventing ink droplet ejection from becoming unstable. While the ambient temperature is lower than the predetermined level, the viscosity of ink is relatively high and therefore stable ink droplet ejection can be ensured even if the printing head 20 is driven by the drive pulse signal 110 having no pulse for reducing residual pressure.

In the experiment, the printing head 20 was driven by the drive pulse signal 100 when the ambient temperature of the printing apparatus 10 was higher than 14° C., and the printing head 20 was driven by the drive pulse signal 110 when the ambient temperature was 14° C. or lower. As to the ink droplet ejection rate in the results of experiment, a deviation from the target value of 8 m/s was less than 2.0 m/s, and the volume of ink per droplet was more than 40 pl (target value).

As described above, in the second preferred embodiment of the printing apparatus 10, either the drive pulse signal 100 or the drive pulse signal 110 is selected according to an ambient temperature in an environment in which the printing apparatus 10 is installed, thereby making it possible to ensure stability in ink droplet ejection rate and adequacy in volume of ink per droplet.

Still more, at a low ambient temperature of less than 14° C. for example, since the printing head 20 is driven by the drive pulse signal 110 having just one drive pulse, the number of times a drive voltage is applied to the printing head 20 is smaller than that taken in a case where the printing head 20 is driven by the drive pulse signal 100 having two drive pulses, thereby reducing a possible increase in temperature of the head driver IC 83.

(Third Embodiment)

In the third embodiment, a drive voltage E is regulated according to variations in the viscosity of ink determined by an ambient temperature Th for the purpose of enhancing ink ejection performance further.

Figures 8, 9, 11:
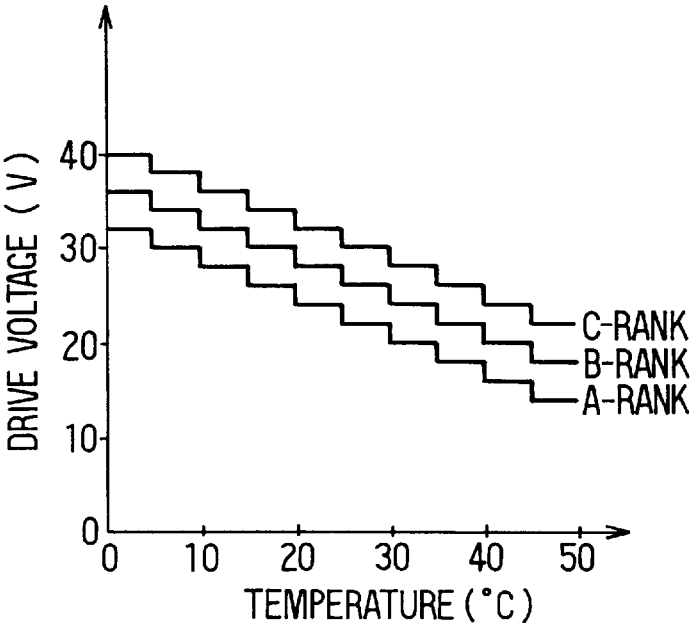
FIG. 8 is a table showing a relation between ambient temperature level ranges and drive voltage levels which are classified for each rank of printing head in the third embodiment.
FIG. 9 is a graph showing pattern memory data of ambient temperature level ranges and drive voltage levels for each rank of printing head in the third embodiment.
FIG. 11 is a table showing a relation between ambient temperature and reference voltage levels for regulating the drive voltage to be applied to the printing head in the third embodiment.
Figure 10:
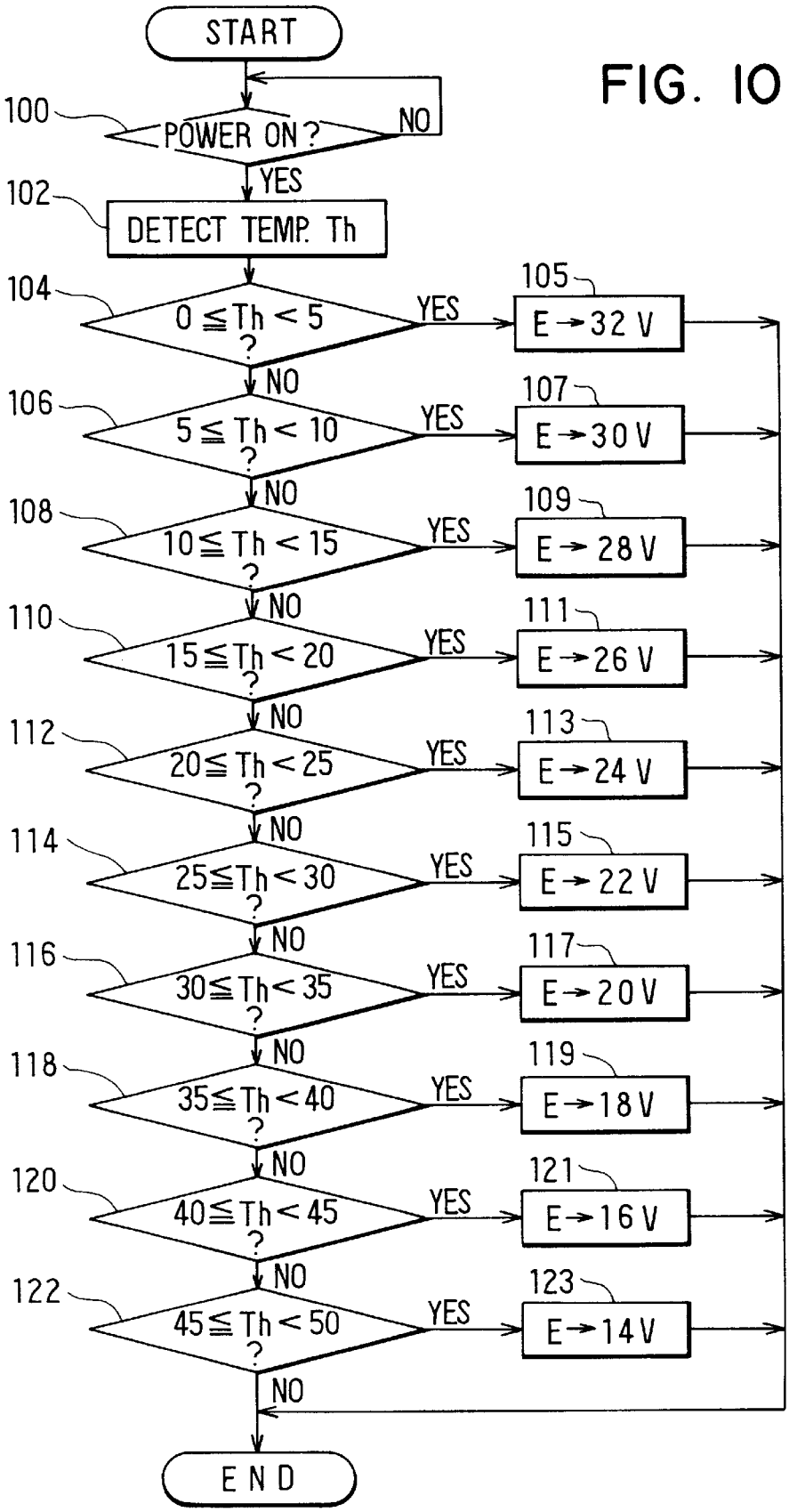
FIG. 10 is a flowchart showing a control procedure to be carried out by a CPU for setting up a proper voltage level in the third embodiment.

Referring to FIG. 8, there is shown a table of ambient temperature level ranges and drive voltage levels which are arranged for each rank of printing head. FIG. 9 is a graph showing pattern memory data of ambient temperature level ranges and drive voltage levels for each rank of printing head. FIG. 10 is a flowchart showing a control procedure to be carried out by the CPU 70 for setting up a proper voltage level.

As shown in FIG. 8, drive voltage levels are classified into three ranks A, B and C. That is, since there are variations in manufacture of printing heads, a drive voltage level for attaining a target value of ink droplet ejection rate is different among them, and therefore the printing heads are classified into the three ranks A, B and C according to the drive voltage level. Therefore, the drive voltage necessary for ejecting ink droplets at a target ejection rate (e.g., 8 m/s) in an environment having a constant ambient temperature (e.g., 25° C.) is determined, and then the printing heads are classified as follows: For instance, if the drive voltage is less than 16 V or it is 23 V or more, the printing head is treated as a defective one. If the drive voltage is 16 V or more and less than 18 V, the printing head is classified as rank A. If it is 18 V or more and less than 20 V, the printing head is classified as rank B. If it is 20 V or more and less than 23 V, the printing head is classified as rank C.

Further, an ambient temperature range from 0° C. to 50° C. is divided in increments of 5° C., and for each divided ambient temperature level range, a drive voltage for attaining a target rate of ink droplet ejection is specified. In this manner, a drive voltage table is mapped and stored in the ROM 74.

As a representative example, the drive voltage control procedure for an A-rank printing head, selected from three ranks, is described below.

First, when power to the printing apparatus 10 is turned on (step 100), the temperature sensor 88 is activated to detect an ambient temperature Th (step 102). Then, it is checked whether the detected ambient temperature Th is 0° C. or higher and lower than 5° C. (step 104). If the detected ambient temperature Th is 0° C. or higher and lower than 5° C., drive voltage data indicating a drive voltage level of 32 V is read from the drive voltage table (FIG. 8) stored in the ROM 74. According to the read-out drive voltage data, a drive voltage change instruction is issued to the power regulator circuit 92 which regulates the voltage of the positive power supply 920 (FIG. 4) so that the drive voltage E is regulated to 32 V (step 105).

If the detected ambient temperature Th is 5° C. or higher, determination is repeated until the detected temperature level range is reached in one of the following steps 106, 108, 110, 112, 114, 116, 118, 120 and 122. Then, when the check step of the corresponding temperature level range is reached, drive voltage data indicating a drive voltage E identified in the check step is read, in corresponding one of steps 107, 109, 111, 113, 115, 117, 119, 121 and 123, from the drive voltage table (FIG. 8) stored in the ROM 74. According to the read-out drive voltage data, a proper drive voltage is set up in the positive power supply 920.

In implementing the third embodiment, the power regulator circuit 92 may be constructed to include an operational amplifier 92*a* (FIG. 2). In case that an operating voltage for the CPU 70 is 5 V, a voltage range is divided into ten levels corresponding to ambient temperature ranges detectable by the temperature sensor 88. In this arrangement, a reference voltage signal having a different voltage value according to variation in ambient temperature is output from an output port of the CPU 70 to the power supply circuit 92.

Each voltage value of the reference voltage signal is provided for the operational amplifier 92*a* used in the power supply circuit 92. The reference voltage signal for the A-rank printing head may be determined as shown in the table of FIG. 11 in correspondence with the detected ambient temperature ranges. It will be understood from a comparison between the tables in FIGS. 8 and 11 that, as the detected ambient temperature increases, the reference voltage to the operational amplifier 92*a* is increased so that the drive voltage from the power supply 920 is decreased. It is of course possible to decrease the reference voltage with the increase in the detected temperature by modifying the circuit configuration of the power regulator circuit 92.

In this implementation, the CPU 70 is programmed to issue the reference voltages in the table of FIG. 11 at the steps 105, 107, 109, 111, 113, 115, 117, 119, 121 and 123 in FIG. 10 in place of the issuance of the drive voltages E. In response to variation in the reference voltage between 0.5 V and 5.0 V, an output voltage of the operational amplifier 92*a* is changed so that the drive voltage of the power supply 920 is regulated by the power supply circuit 92 to vary between 32 V and 14V.

Reference voltage tables for B-rank and C-rank printing heads are not exemplified in FIG. 11. Voltage values different from those of reference voltage signals specified in the drive voltage table for the A-rank printing head are may be provided in the drive voltage tables for the B-rank and C-rank printing heads in the similar manner to correspond to the required drive voltages (FIG. 8) for the B-rank and C-rank printing heads.

In order for the CPU 70 to apply the reference signal indicating a particular voltage value from the output port thereof to the power regulator circuit 92, there may be provided such an arrangement that a digital reference signal having a particular bit pattern is output from the output port to the power regulator circuit 92 according to the ambient temperature detected by the temperature sensor 88, the bit pattern of the digital reference signal is read by a D/A converter circuit included in the power regulator circuit 92, and the drive voltage of the power supply 920 is set up according to an output signal from the D/A circuit.

As described above, in the third embodiment of the printing apparatus 10, the printing head 20 can be driven by a drive voltage regulated according to characteristics of the printing head 20 and variation in ambient temperature in an installation environment of the printing apparatus 10, i.e., variation in viscosity of ink, thereby making it possible to suppress variation in ink droplet ejection rate, variation in volume of ink per droplet and deviation of ink droplet ejecting direction. More particularly, in comparison with a case where the printing head 20 is driven by a constant drive voltage, the drive voltage is decreased as the viscosity of ink to be ejected becomes higher so that the residual pressure in the ink channel 205 may be reduced to suppress vibration of the meniscus 292 at the nozzle 206. It is therefore possible to further improve stability in ink droplet ejection rate and adequacy in volume of ink per droplet in a wide range of ambient temperature, resulting in still higher quality of printing.

(Other Embodiments)

In each of the above preferred embodiments, the positive power supply 920 is used. Instead, a negative power supply may be used in an arrangement that the shear mode actuator wall 203 is polarized in the directions opposite to arrows F30 and F40 indicated in FIG. 12. Also, while the upper wall 203*a* and the lower wall 203*b* of the shear mode actuator wall 203 are deformed by means of piezoelectric thickness slip deformation to change the volume of the ink channel 205 for ejecting ink droplets, it is possible to provide an arrangement that one of the upper wall 203*a* and the lower wall 203*b* is made of any material not allowing piezoelectric thickness slip deformation and the other wall allowing piezoelectric thickness slip deformation is deformed to change the volume of the ink channel 205 for emitting ink droplets.

Still more, while the air channel 212 is provided on both sides of the ink channel 205 in each of the present preferred embodiments, it is to be understood that ink channels may be arranged adjacently without providing any air channel.

Still more, it is to be understood that the printing apparatus 10 may comprise a data generating section (host computer) and a printing section (printer) connected therewith, wherein entire control operation for the present invention is carried out by control means including a CPU in the data generating section. In this arrangement, a program to be run on the data generating section for the purpose of the control operation may be made available on such storage media as computer-readable magnetic print media.

The present invention should not be limited to the disclosed embodiments but may be implemented in various ways without departing from the spirit of the invention.

What is claimed is:

1. An ink-jet printing apparatus comprising:

a printing head having an ink channel, an actuator for changing a volume of the ink channel and a nozzle connected with the ink channel to eject the ink from the ink channel onto a print media; and a drive circuit connected to the printing head for applying a first drive pulse signal to the actuator so that the ink channel is expanded a volume thereof to generate a pressure wave in the ink channel and, after a lapse of an approximate odd-numbered multiple of one-way propagation time T of the pressure wave in the ink channel, an expanded volume of the ink channel is decreased to normal state thereof to apply pressure to the ink in the ink channel for ejecting the ink from the ink channel through the nozzle, wherein the drive circuit, after applying the first drive pulse signal to the actuator, applies to the actuator a second drive pulse signal which has a center thereof in a range of approximately 2.25 to 2.75 times the one-way propagation time T from an end time of the first drive pulse signal.

2. An ink-jet printing apparatus comprising:

a printing head having an ink channel, an actuator for changing a volume of the ink channel and a nozzle connected with the ink channel to eject the ink from the ink channel onto a print media; and a drive circuit connected to the printing head for applying a first drive pulse signal to the actuator so that the ink channel is expanded a volume thereof to generate a pressure wave in the ink channel and, after a lapse of an approximate odd-numbered multiple of one-way propagation time T of the pressure wave in the ink channel, an expanded volume of the ink channel is decreased to normal state thereof to apply pressure to the ink in the ink channel for ejecting the ink from the ink channel through the nozzle, wherein the drive circuit, after applying the first drive pulse signal to the actuator, applies to the actuator a second drive pulse signal which has a magnitude substantially equal to that of the first drive pulse signal and a pulse width equal to approximately 1.6 to 1.8 times the one-way propagation time T so that a center of the second drive pulse signal is provided in a range of approximately 2.25 to 2.75 times the one-way propagation time T from an end time of the first drive pulse signal.

3. The ink-jet printing apparatus according to claim 2, further comprising:

a detecting device connected to the drive circuit for detecting a parameter indicative of a viscosity of the ink, wherein the drive circuit restricts the second drive pulse signal from being applied to the actuator when the detected parameter is indicative of the viscosity being lower than a predetermined level.

4. The ink-jet printing apparatus according to claim 3, wherein the detecting device includes an ambient temperature sensor for detecting an ambient temperature around the printing head.

5. The ink-jet printing apparatus according to claim 3, wherein the drive circuit includes a regulator operatively connected to the detecting device for regulating voltages of the first and second drive pulse signals according to the detected parameter.

6. The ink-jet printing apparatus according to claim 5, wherein the regulator is constructed to decrease the voltages as the viscosity of the ink indicated by the detected parameter decreases.

7. The ink-jet printing apparatus according to claim 6, wherein the regulator is constructed to change the voltages in accordance with a voltage required by the printing head to eject the ink at a predetermined speed.

8. The ink-jet printing apparatus according to claim 2, wherein the actuator includes at least one wall part defining the ink channel and at least one area of the wall part is formed by a piezoelectric material.

9. The ink-jet printing apparatus according to claim 2, wherein the center of the second drive pulse signal is provided in a range of approximately 2.30 to 2.70 times the one-way propagation time T from the end time of the first drive pulse signal.

10. The ink-jet printing apparatus according to claim 2, wherein the pulse width of the second drive pulse signal is approximately 1.6 to 1.7 times the one-way propagation time T.

11. The ink-jet printing apparatus according to claim 2, wherein the pulse width of the second drive pulse signal is approximately 1.6 to 1.7 times the one-way propagation time T and the center of the second drive pulse signal is provided in a range of approximately 2.30 to 2.70 times the one-way propagation time T from the end time of the first drive pulse signal.

12. An ink-jet printing apparatus comprising:

a printing head including an ink channel, an actuator driven by a drive signal for changing pressure in the ink channel and a nozzle connected with the ink channel so that ink is ejected from the ink channel onto print media by changes in pressure in the ink channel;

temperature detecting device for detecting an ambient temperature around the printer head; and a drive circuit connected between the temperature detecting device and the actuator for applying the drive signal to the actuator, the drive circuit including a reference voltage setting part for setting a drive voltage of the drive signal according to printing head characteristics and the detected ambient temperature so that a rate of ink droplet ejection from the nozzle is adjusted to a predetermined ink droplet ejection rate, wherein the reference voltage setting part has a data table defining a relationship of the drive voltage relative to the printing head characteristics and the ambient temperature so that the drive voltage is set with reference to the data table.

13. The ink-jet printing apparatus according to claim 12, wherein the reference voltage setting part decreases the drive voltage as the detected ambient temperature becomes higher.

14. The ink-jet printing apparatus according to claim 12, wherein the reference voltage setting part regulates the drive voltage to any one of plural predetermined drive voltage levels in response to the detected ambient temperature.

15. The ink-jet printing apparatus according to claim 12, wherein the reference voltage setting part is provided with a plurality of data patterns of printing head characteristics for drive voltage levels corresponding to temperature level ranges detectable by the temperature detecting device and sets the drive voltage in response to the detected ambient temperature.

16. An ink-jet printing apparatus comprising:

a printing head including an ink channel, an actuator driven by a drive signal for changing pressure in the ink channel and a nozzle connected with the ink channel so that ink is ejected from the ink channel onto print media by changes in pressure in the ink channel;

detecting circuit for detecting a parameter variable with a viscosity of the ink to be ejected;

a memory defined in a form of a data table which defines a relationship of a drive voltage of the drive signal relative to the operation characteristics of the printing head and the parameter; and a drive circuit for applying the drive signal to the actuator, the drive circuit being for variably setting the drive voltage of the drive signal in dependence on the detected parameter and the operation characteristics with reference to the data table in the memory.

17. The ink-jet printing apparatus according to claim 16, wherein the drive voltage is decreased as the detected parameter indicates an increase in the viscosity of the ink.

18. The ink-jet printing apparatus according to claim 17, wherein the drive voltage is further decreased as the operation characteristics of the printing head is ranked as requiring a lower voltage for ejecting the ink at a predetermined speed.

19. The ink-jet printing apparatus according to claim 16, wherein the detecting device detects an ambient temperature around the printing head and the drive voltage is decreased as the detected ambient temperature becomes higher.

* * * * *